US006364552B1

(12) United States Patent
Nehowig et al.

(10) Patent No.: US 6,364,552 B1
(45) Date of Patent: Apr. 2, 2002

(54) METHOD AND APPARATUS FOR RECORDING USED LABELS

(75) Inventors: Kelly R. Nehowig, Maple Grove; Douglas R. Kremers, Champlin; Richard P. Fisher, Eden Prairie, all of MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/349,818

(22) Filed: Jul. 8, 1999

(51) Int. Cl.[7] ..... B41J 15/04
(52) U.S. Cl. ..... 400/613; 400/611
(58) Field of Search ..... 400/613, 611, 400/609, 83; 347/198, 407.1, 288

(56) References Cited

U.S. PATENT DOCUMENTS 2,771,251 A * 11/1956 Silverstein ..... 242/596.1
4,239,404 A * 12/1980 DeFilipps et al. ..... 400/613
4,440,248 A 4/1984 Teraoka ..... 177/4
4,479,615 A * 10/1984 Nakajima et al. ..... 242/68.2
4,501,224 A 2/1985 Shibayama et al. ..... 118/697
4,630,538 A 12/1986 Cushman ..... 101/45
4,655,129 A 4/1987 Wirth et al. ..... 101/35
4,734,713 A * 3/1988 Sato et al. ..... 400/611
4,807,177 A * 2/1989 Ward ..... 400/611
5,078,523 A 1/1992 McGourty et al. ..... 400/613
5,918,989 A * 7/1999 Stout et al. ..... 400/613

* cited by examiner

*Primary Examiner*—John S. Hilten
*Assistant Examiner*—Anthony Nguyen
(74) *Attorney, Agent, or Firm*—Quarles & Brady LLP

(57) ABSTRACT

A thermal transfer printer which includes a labeling media drive subassembly and ribbon drive subassembly which cooperatively advance labeling media and a thermal transfer ink ribbon past a print head subassembly. A labeling media supply spool is rotatably driven by the labeling media drive subassembly to feed labeling media. The labeling media supply spool has labeling media with a plurality of labels on a web wrapped around a spool core. An inventory of labels available for printing on the spool is stored on a memory device. The memory device is electrically connected to printer circuitry in a printer. When the printer prints on a label, the inventory on the memory device is updated to reflect the unavailability of the printed label.

13 Claims, 11 Drawing Sheets

METHOD AND APPARATUS FOR RECORDING USED LABELS

TECHNICAL FIELD

The present invention relates to printer supply spools, particularly to a method and apparatus for maintaining a transportable inventory of labels available for printing remaining on a supply spool.

DESCRIPTION OF THE BACKGROUND ART

There are a number of U.S. patents that disclose electronic apparatus for printing indicia on labels, some of which are described in U.S. Pat. No. 4,440,248, Teraoka; U.S. Pat. No. 4,501,224, Shibayama; U.S. Pat. No. 4,630,538, Cushing; and U.S. Pat. No. 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information concerning the indicia to be printed, and a visual display such as a LED/LCD unit to assist the operator in using the machine.

The labeling media comprises a roll of pressure sensitive tape (continuous media or die cut labels)that is attached to a continuous roll of release liner. The release liner is fed through the printer and legends are printed on the label media. Labels are formed by cutting the tape after the legends are printed on the continuous media or by printing on the die cut label media. The labels are then removed from the release liner and attached to the objects needing identification. As there are many types of label applications, there are many combinations of label materials and release liners that provide labels of varying sizes, colors, formats, and environmental resistance.

A particular type of print head employs thermal transfer printing technology. Thermal transfer printing uses a heat generating print head to transfer colored coating containing wax, carbon black, or the like, from a thermal transfer ribbon to a labeling media. By using digital technology, characters are formed by energizing a sequence of pixels on the print head which in turn melt the coating on the ribbon transferring the image to the labeling media.

In a known thermal transfer printer such as a label printer, labeling media is fed by a platen roller simultaneously with a ribbon feed roller feeding an ink transfer ribbon. While the labeling media driven by the platen roller runs between the print head and the rotating platen roller, the transfer ribbon is passed between the print head and the platen roller by rotating the ribbon feed roller. As a result, the labeling media and the transfer ribbon pass together in overlay relationship between the print head and the platen roller.

One particular labeling media known in the art is die cut labels which are removably mounted on a release liner or web in rows across the web width. When printing die cut labels on a thermal transfer, continuous media printer, arranged with more than one die cut label across the web width, if the printer ceases printing and all of the labels in a row are not used, there is no known method in the prior art to automatically determine which labels in the row are available for printing. This results in label waste, as the printer must assume a potentially incorrect label configuration. This situation can also occur when a partially used labeling media spool is inserted into a printer. If a row is partially used, the user must advance the labeling media to the first full row wasting the labels in the partially used row.

SUMMARY OF THE INVENTION

The present invention provides a thermal transfer printer which includes: a spool that carries labeling media comprised of rows of labels mounted along the length of a web rolled up on the spool; an inventory of the labels is stored on an electronic memory device mounted to the spool; and the memory device is electrically connected to printer circuitry when the spool is mounted therein. When the printer prints on a label, the inventory on the memory device is updated to reflect the unavailability of the printed label.

The present invention accomplishes the general objective of maintaining an inventory of labels available for printing in a labeling media supply spool. This objective is accomplished by providing a memory device associated with the spool containing a label inventory, and updating the inventory when a label is used.

Another objective of the present invention is to provide a transportable label inventory for a partially used labeling media supply spool. This objective is accomplished by attaching the memory device having the inventory stored therein to the labeling media supply spool.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE PREFERRED EMBODIMENTS

Figure 1:
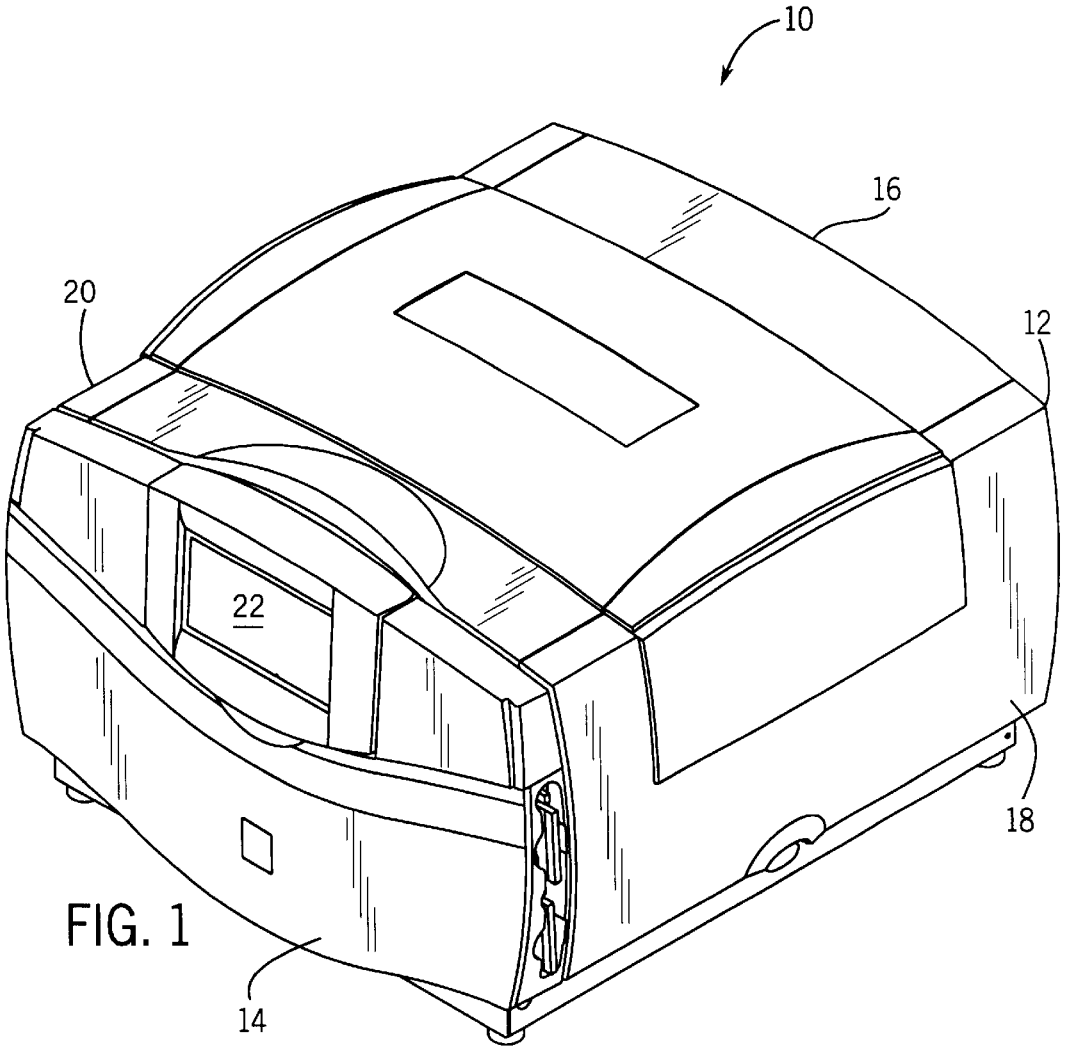
FIG. 1 is a front, right side perspective view of a thermal transfer printer which employs the present invention.

As shown in FIGS. 1–8, a thermal transfer printing machine 10 which employs the preferred embodiment of the present invention includes a molded plastic housing 12 having a front 14, opposing sides 18, 20, and a metal back 16. The housing 12 encloses printer subassemblies 28, 30, 32, 34, and 36 mounted on a chassis 38 (shown in FIGS. 3–5), and supports a LCD display 22 pivotally mounted to the housing front 14. Labels 43 printed on labeling media 40 are ejected from the printer 10 down an exit chute 24, and through an opening 26 formed in the housing side 20. The LCD display 22 displays printer status and error indicators to a user. Printer circuitry 44 mounted to the chassis 38 controls the printer subassemblies 28, 30, 32, 34, and 36 and powers the LCD display 22.

Referring to FIGS. 2–5, the printer chassis 38 is supported by a substantially rectangular base 46 which provides the foundation for the printer 10. The base 46 has a top 48, bottom 50, and sides 52. Four feet 54 mounted in each corner of the base bottom 50 support the base 46. The housing 12 is attached to the base 46 with screws (not shown) threadably engaging clips 55 extending from the base sides 52.

The chassis 38 supports the subassemblies 28, 30, 32, 34, and 36, and has a bottom frame 53 mounted to the printer base top 48, and a top frame 56 pivotally mounted to the bottom frame 53. Looking particularly at FIG. 4, the chassis bottom frame member 53 includes a pair of opposing frame side members 58 mounted to the base top 48 using screws or the like, and supports a labeling media drive subassembly 28, a cutter subassembly 34, and a label eject subassembly 36. Looking particularly at FIGS. 5 and 6, the chassis top frame 56 has an end frame member 60 joining a pair of opposing frame side members 62 which support a print head subassembly 30 and a thermal transfer ink ribbon subassembly 32.

Figure 7:
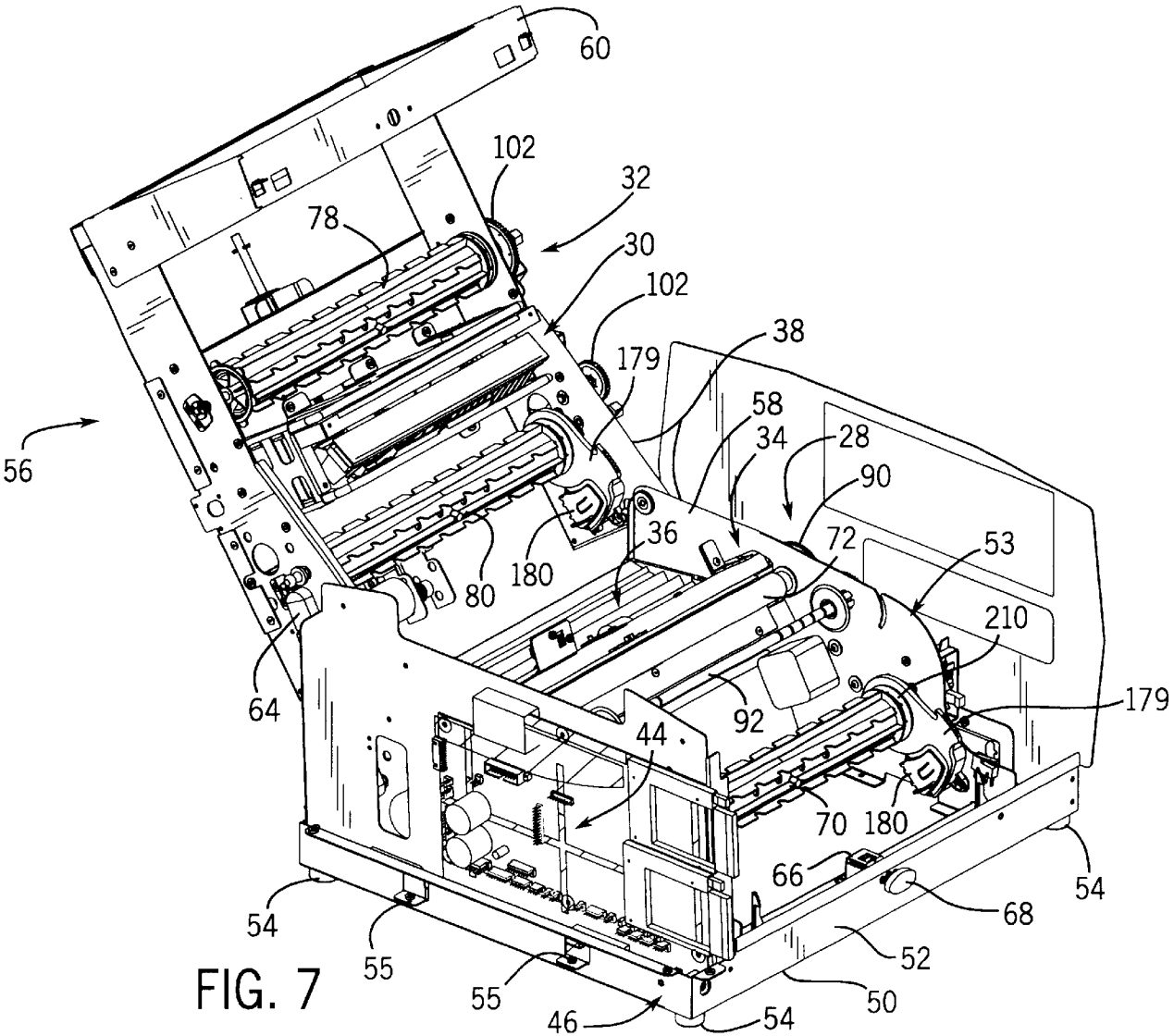
FIG. 7 is a front, right perspective view of the printer in an open configuration.

As shown in FIG. 7, pivotally mounting the top frame 56 allows the user to open the chassis 38 in a clam-shell fashion exposing the subassemblies 28, 30, 32, 34, and 36 for easy maintenance. A pneumatic piston 64 mounted to the top and bottom frames 56,53 restricts the chassis 38 from opening too quickly and damaging the subassemblies 28, 30, 32, 34, and 36 from jarring. Looking at FIG. 7, a latch 66 mounted to the base side 52 catches the chassis top frame member 60 to hold the chassis 38 in the closed position during printer operation, and is released by a button 68 mounted to the base side 52.

Referring back to FIGS. 3 and 4, the labeling media drive subassembly 28 feeds labeling media 40 from the rotatably mounted labeling media supply spool 70 past the print head assembly 30. The labeling media 40 is comprised of a carrier web 41 which supports an adhesively backed material, such as labels 43 or a continuous sheet of vinyl or polyester. The size, color, and type of label material carried by the spool 70 varies depending upon the particular print application.

The labeling media 40 unrolls off the spool 70 as it is driven by the labeling media drive subassembly 28. The labeling media drive subassembly 28 includes a master drive cone 84 (shown in FIG. 8) rotatably mounted to one of the chassis bottom frame side members 58, and a slave cone 86 rotatably mounted to the opposing chassis bottom frame side member 58. The cones 84,86 support the labeling media supply spool 70 therebetween. A stepping motor 88, mounted to the same frame member 58 as the master drive cone 84, rotatably drives the master drive cone 84 to dispense labeling media 40 from the supply spool 70. A stepping motor gear mechanism 90 driven by the stepping motor 88 drives an idler roller 92 and the platen 72 to feed the labeling media 40 past the print head assembly 30.

Figure 3:
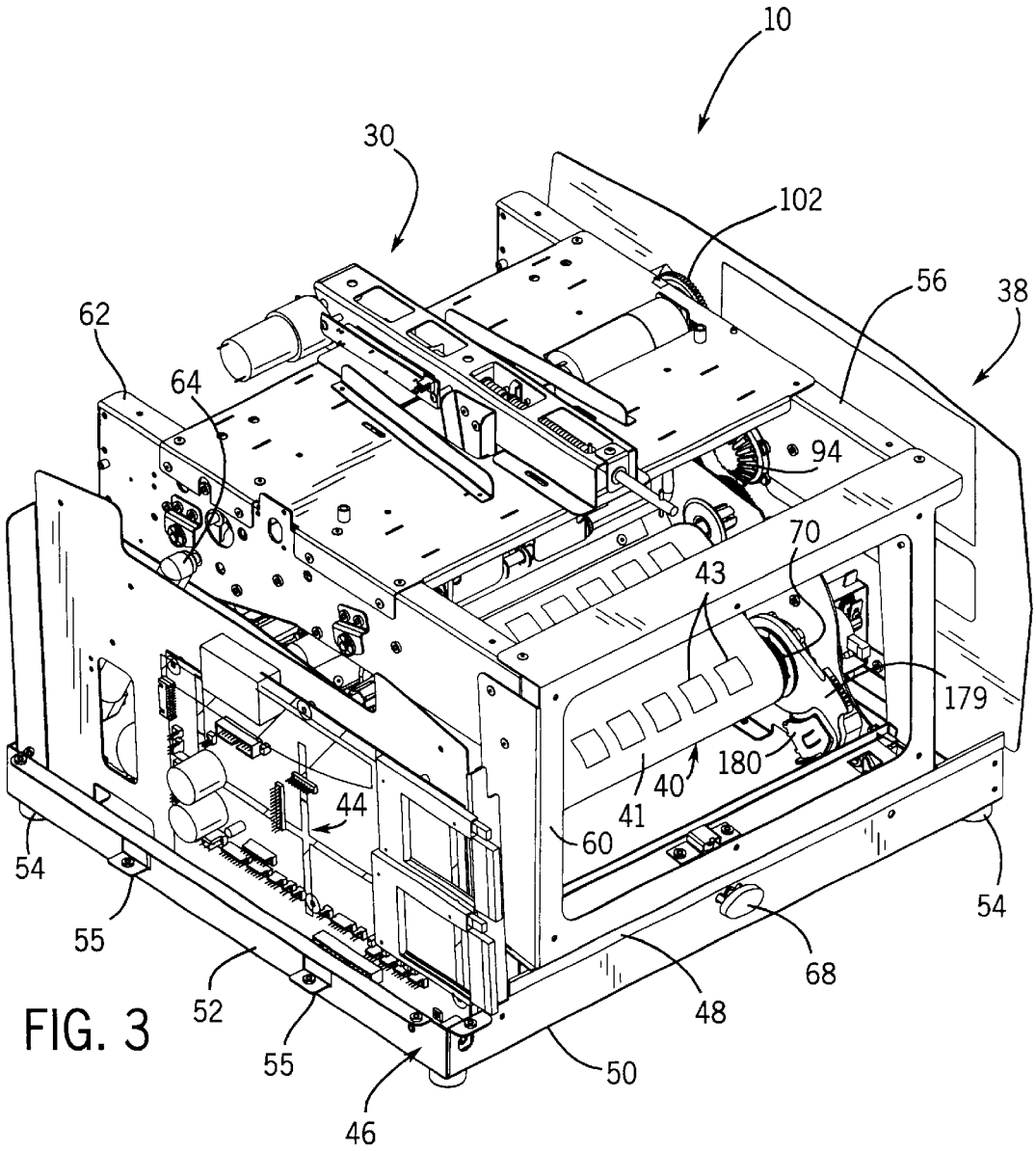
FIG. 3 is a front, right side perspective view of the printer of FIG. 1 with the housing removed.
Figure 10:
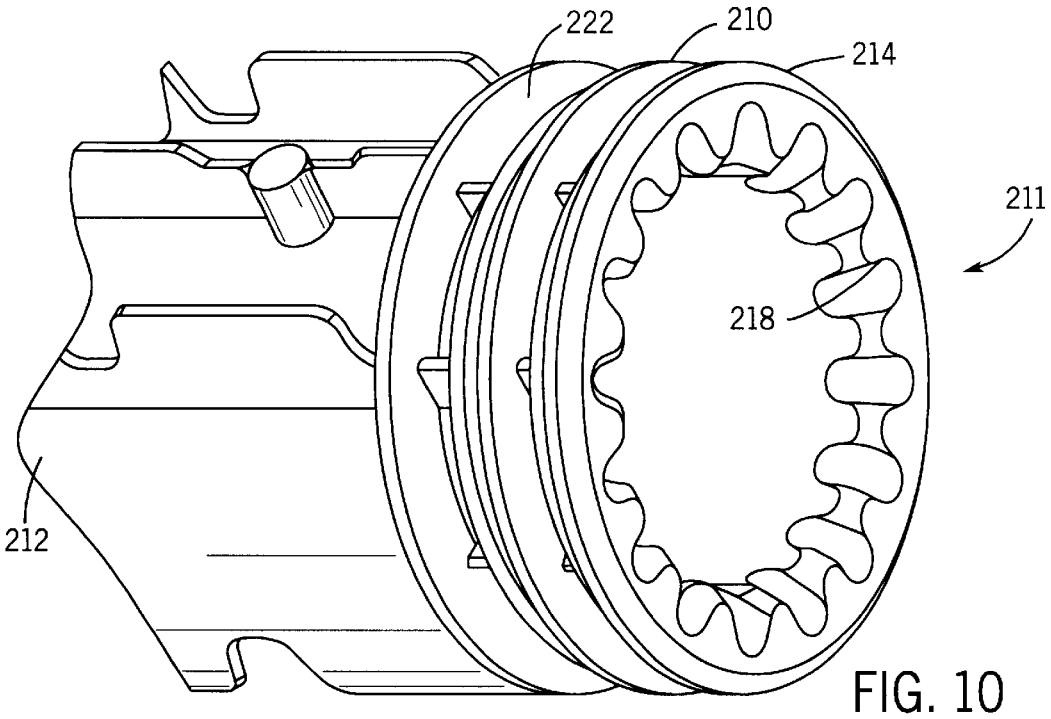
FIG. 10 is a perspective view of one end of a labeling media supply spool.

Referring to FIGS. 3 and 10, the labeling media supply spool 70 includes labeling media 40 wrapped around an elongated body 212 having opposing spool ends 210. A circumferential groove 222 formed in the spool body 212 proximal one of the spool ends 210 receives a chip holder 179 described in detail below. The spool ends 210 have sockets 211 formed to engage the labeling media drive subassembly cones, such as fully described in a copending U.S. patent application entitled "PRINTER SPOOL", having U.S. Ser. No. 09/349,825 filed concurrently with the present application, and which is fully incorporated herein by reference.

Referring to FIGS. 3, 7, and 10–13, an electronic memory device 175 is mounted on the chip holder 179 which is slidably mounted to the spool end 210. The chip holder 179 positions the memory device 175 to electrically connect with a set of stationary contacts 181 which are part of the printer circuitry 44. The stationary contacts 181 are mounted in an electrical receptacle 180 which is mounted to the chassis side frame 58 proximal the spool end 210. As the spool 70 rotates during use, the memory device 175 remains fixed to the stationary contacts 181 to communicate with the printer circuitry 44.

Figure 11:
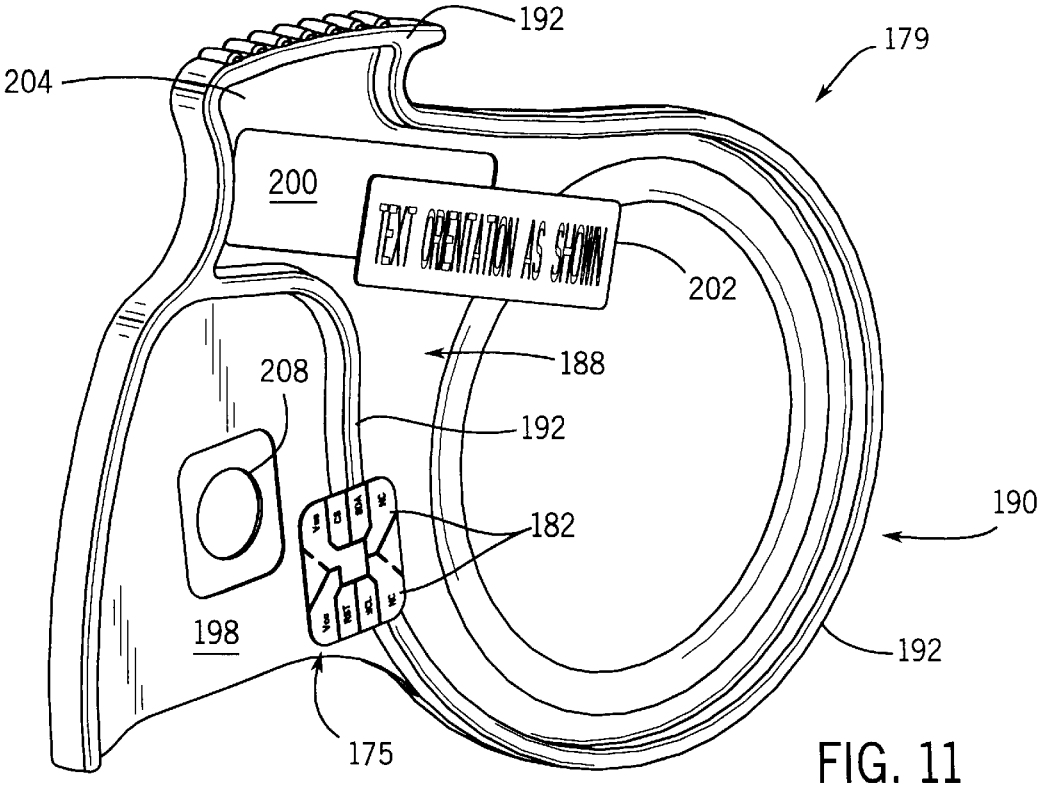
FIG. 11 is a side view of the memory device of FIG. 12.
Figures 12, 13:
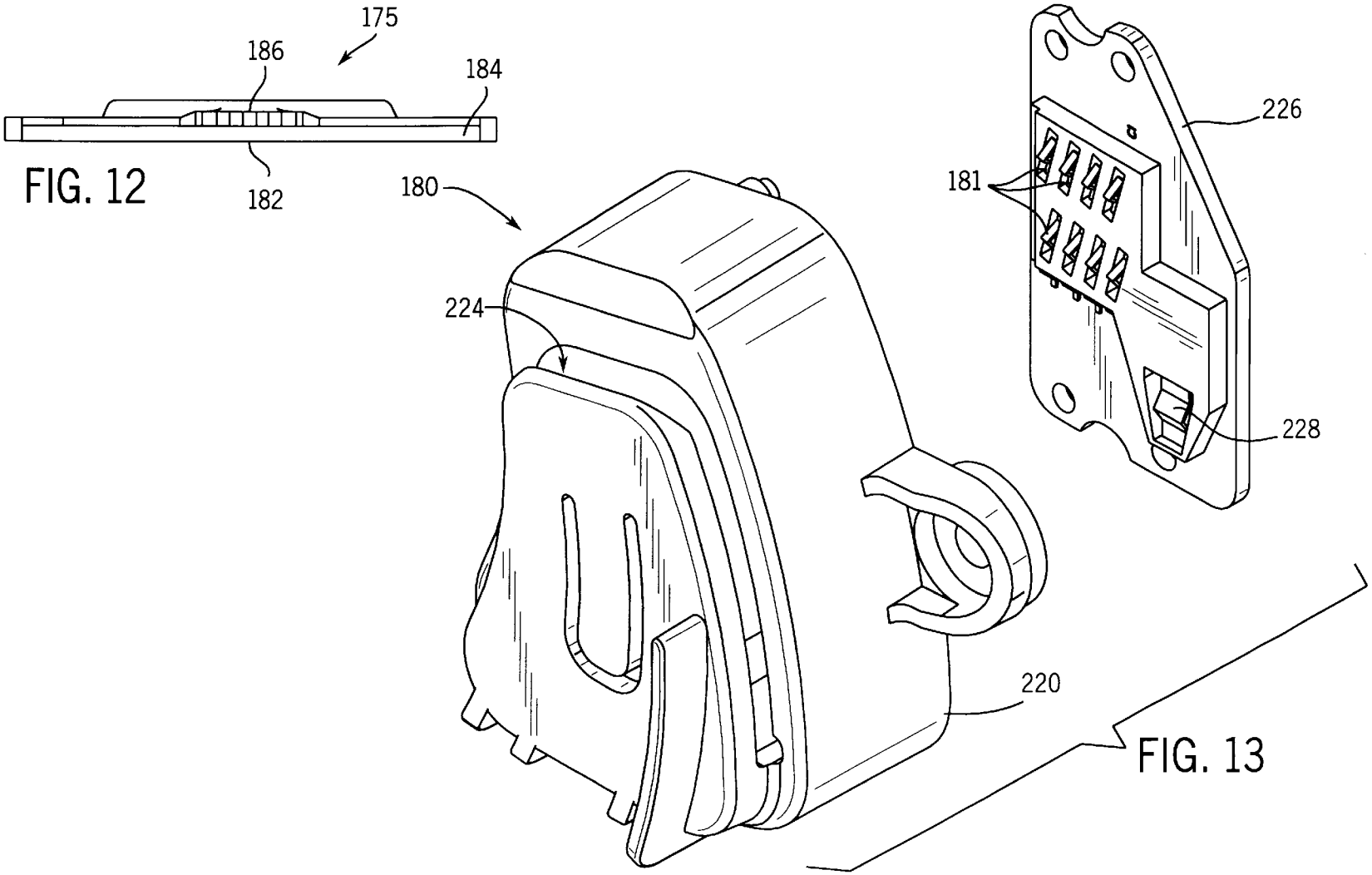
FIG. 12 is a side view of the chip holder of FIG. 7.
FIG. 13 is an exploded view of the electrical receptacle of FIG. 7.

The memory device 175 is an electrically alterable read only memory (EAROM),such as the Xicor X76F101 smart chip, available from Xicor, Inc., Sunnyvale, Calif. The contents of the memory device 175 can be changed, but are not lost when power is removed from the device 175. As shown in FIGS. 11 and 12, the memory device 175 includes a printed circuit board 184 having the memory device in integrated circuit form 186 mounted on one side, and electrical contacts 182 (best shown in FIG. 11) electrically connected to the integrated circuit 186 etched into the other side.

Referring to FIGS. 3 and 11, the memory device 175 stores a supply spool label inventory including the number and location of every label 43 of the labeling media 40 on the supply spool 70 available for printing. A label available for printing is either an unprinted label or, in the case of a label capable of being printed on multiple times, the number of remaining available printings on a particular label. Other information, such as date of manufacture, labeling media web width, desired platen pressure, and the like, can also be stored on the memory device 175.

Figure 9:
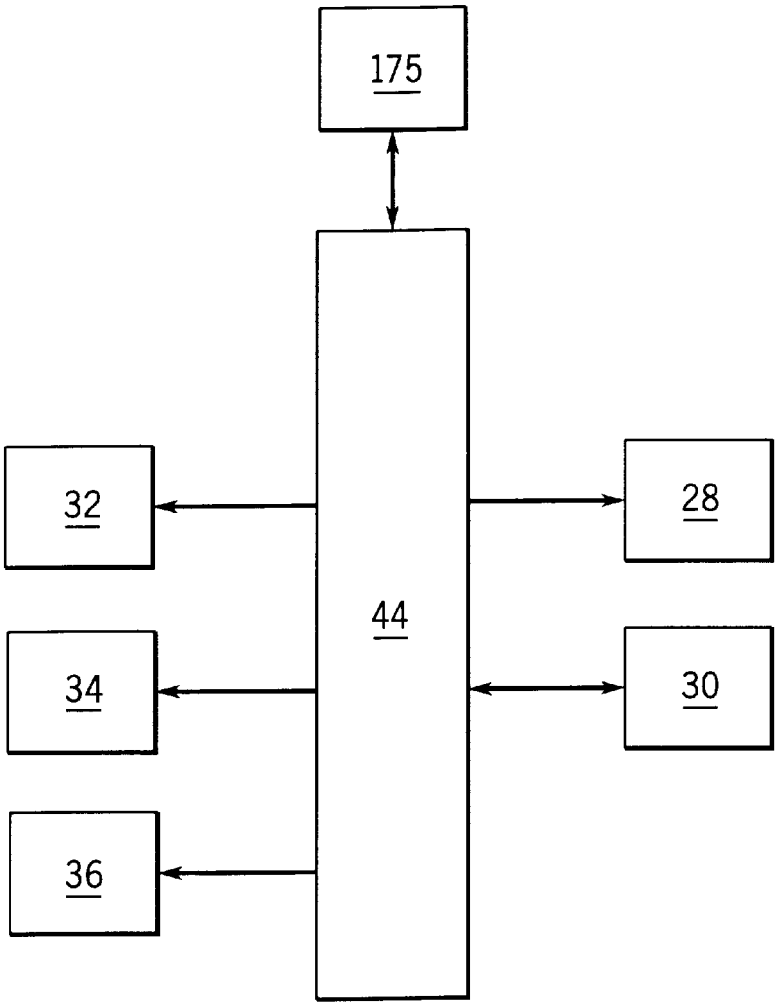
FIG. 9 is a block diagram of printer circuitry of the printer of FIG. 1.

As shown in FIG. 9, the printer circuitry 44 is electrically connected to the memory device 175, and controls the printer subassemblies 28, 30, 32, 34. The printer circuitry 44 may perform a "read" operation to acquire information from the memory device 175, such as the inventory of labels available for printing. As the print head subassembly 30 prints, the printer circuitry 44 performs a "write" operation to update the label inventory. This ensures every available label is used.

As shown in FIGS. 3 and 11, the memory device 175 is mounted to a chip holder 179 which secures the memory device 175 to the labeling media supply spool 70, and properly locates the memory device electrical contacts 182 within an electrical receptacle 180 (shown in FIGS. 3 and 7) mounted to the chassis side frame proximal the spool end 210. Electrical contacts 181, shown in FIG. 13, mounted in the electrical receptacle 180 engage the memory device electrical contacts 182 to electrically connect the memory device 175 to the printer circuitry 44 (shown in FIG. 9).

Referring to FIGS. 3, 7, and 11, the chip holder 179 encircles the spool end 210, and has a substantially flat portion 188 for affixing a label 202 and mounting the memory device 175 thereon. A loop 190 extends from the flat portion 188, and is received in the groove 222 formed proximal the spool end 210 to slidably attach the chip holder 179 to the spool end 210.

A rib 192 formed on the loop periphery strengthens the loop 190, and extends through the flat portion 188 to divide it into a chip mounting section 198 and a label section 200. Advantageously, the rib 192 also serves as a stop to abut the electrical receptacle 180 and properly locate the chip electrical contacts 182 in the receptacle 180.

The chip holder flat portion label section 200 receives a label 202 for providing machine readable information, such as a barcode, and user readable information, such as printed text. A finger lip 204 extends from the label section 200 to aid the user when inserting or extracting the chip holder 179 from the electrical receptacle 180. The rib 192 extends along an outer edge of the finger lip 204 to provide a surface for the user to press the holder 179 into the receptacle 180, or to grasp and pull the holder 179 out of the receptacle 180.

The chip mounting section 198 has a cavity 208 formed therein for receiving the memory device 175. The memory device 175 is mounted in the cavity 208, using methods known in the art, such as ultrasonic welding, adhesives and the like, so as to present the electrical contacts 182 in a predetermined orientation for engagement by the stationary electrical receptacle contacts 181.

Referring to FIGS. 7, 9, 11, and 13, the chip mounting section 198 is slipped into a slot 224 formed in the electrical receptacle 180 to electrically connect the memory device 175 to the printer circuitry 44. As shown in FIG. 13, the electrical receptacle 180 has a housing 220 with the slot 224 for receiving the chip mounting section 198 of the chip holder 179. The stationary receptacle contacts 181 are mounted in the receptacle housing 220 on a removable plate 226 to simplify assembly, and are arranged facing the slot 224 to electrically engage the memory device electrical contacts 182. A limit switch 228 mounted to the plate 226 is electrically connected to the printer circuitry 44, and provides a signal to the circuitry 44 when the chip holder 179 is fully inserted in the housing slot 224. Preferably, the electrical receptacle 180 is a memory cell reader, available from Amphenol of Canton, Mich., which has stationary electrical contacts specially adapted for engaging the preferred smart chip electrical contacts.

Referring now to FIGS. 5–8, the thermal transfer ink ribbon drive subassembly 32 is mounted to the chassis top frame 56, and feeds the thermal transfer ink ribbon 76 past the print head subassembly 30 from an ink ribbon supply spool 78 to an ink ribbon take up spool 80. The ink ribbon drive subassembly 32 includes an ink ribbon supply spool master drive cone 94 and opposing slave cone 96, an ink ribbon take up spool master drive cone 98 and opposing slave cone 100, and a gear mechanism 102 for rotatably driving the master drive cones 54,58.

As in the labeling media drive subassembly 28, each ink ribbon spool 78,80 is supported at its ends by the master drive cone 94,98 and the opposing slave cone 96,100. The master drive cones 94,98 are rotatably driven by the gear mechanism 102 mounted on one side of the top frame side member 62 to rotatably drive the take up spool 80 and pull the ink ribbon 76 past the print head 74. The gear mechanism 102 is mounted on the same top frame side member 62 as the master drive cones 94,98 and engages the labeling media drive gear mechanism 90 to provide synchronous movement of the labeling media 40 and ink ribbon 76 past the print head 74.

Figure 8:
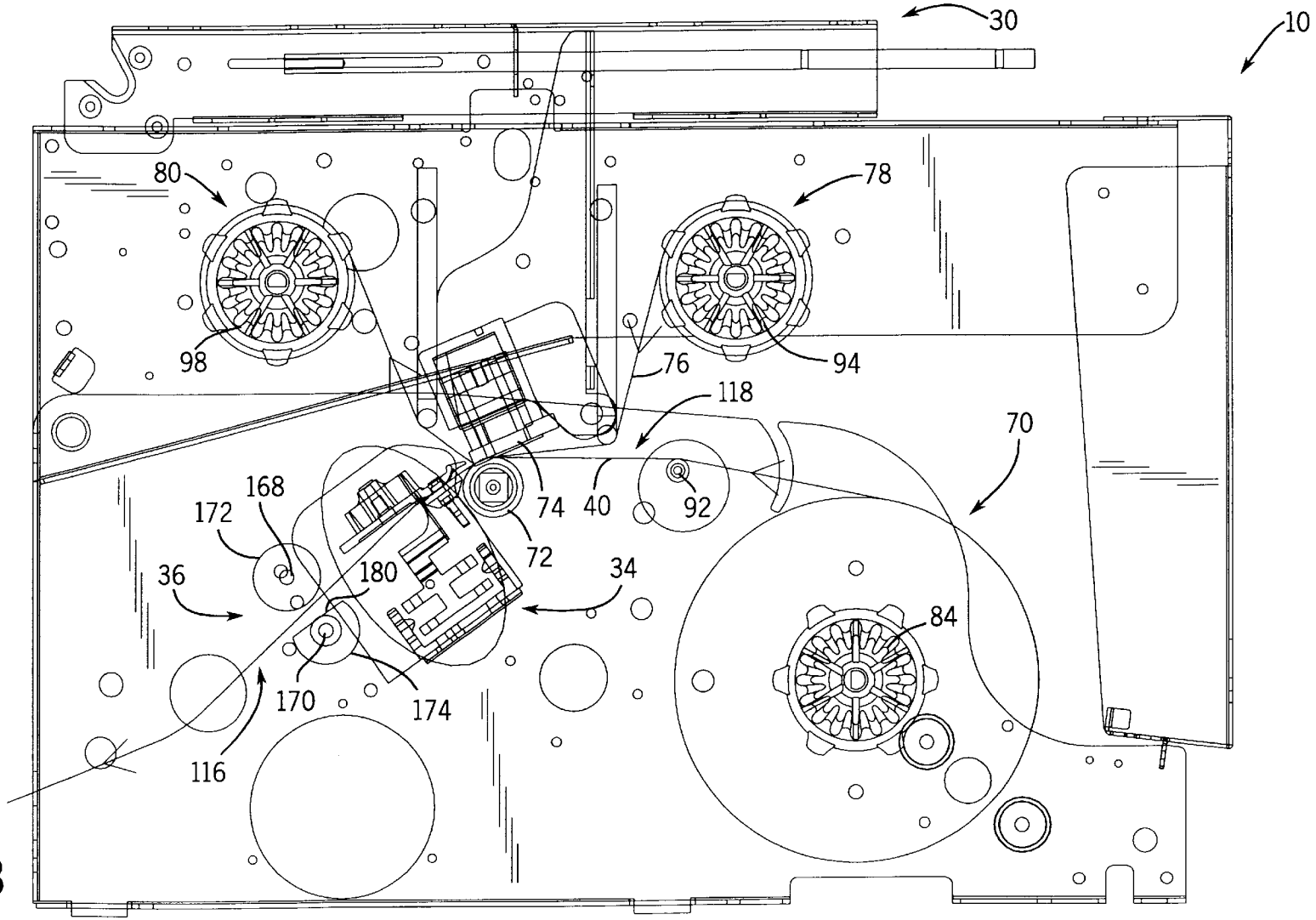
FIG. 8 is a sectional elevation view of FIG. 3 showing the media and ribbon paths.

As shown in FIG. 8, the print head subassembly 30 in the printer 10 is arranged to cooperate with the thermal transfer ribbon 76 and the labeling media 40 such that the thermal print head 74 can print characters or symbols on the labeling media 40. Thermal transfer printing is described in greater detail in U.S. Pat. No. 5,078,523 which is incorporated herein by reference.

The labeling media 40 and ribbon 76 are advanced past the print head subassembly 30 by the platen 72 which urges the ribbon 76 and labeling media 40 in close cooperation with the print head 74. The print head subassembly 30 is fully described in a copending U.S. patent application entitled "PRINTER WITH VARIABLE PLATEN PRESSURE", Ser. No. 09/349,529now U.S. Pat. No. 6,266,075 filed concurrently with the present application, and which is fully incorporated herein by reference.

Figure 2:
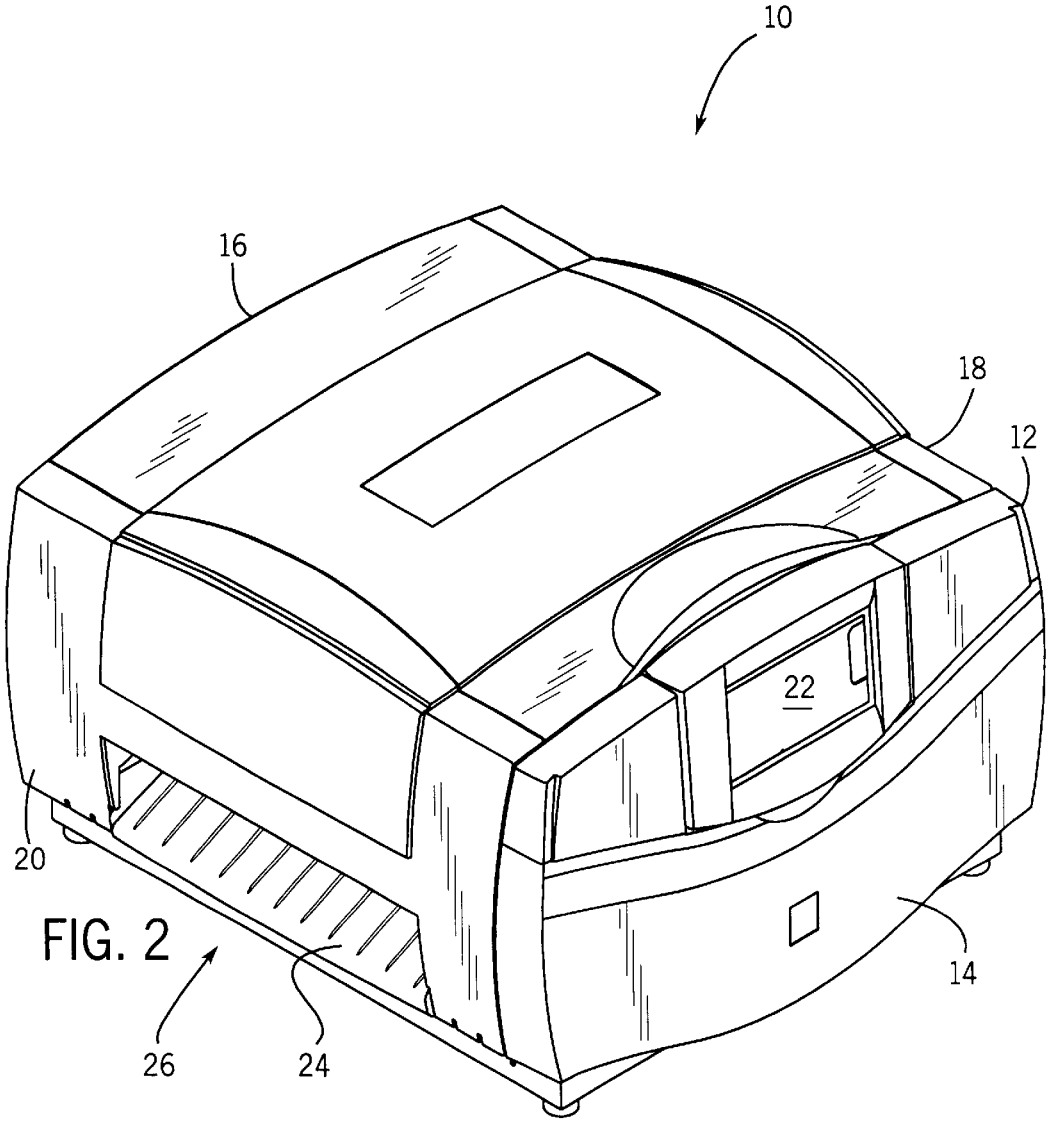
FIG. 2 is a front, left side perspective view of the printer in FIG. 1.
Figure 4:
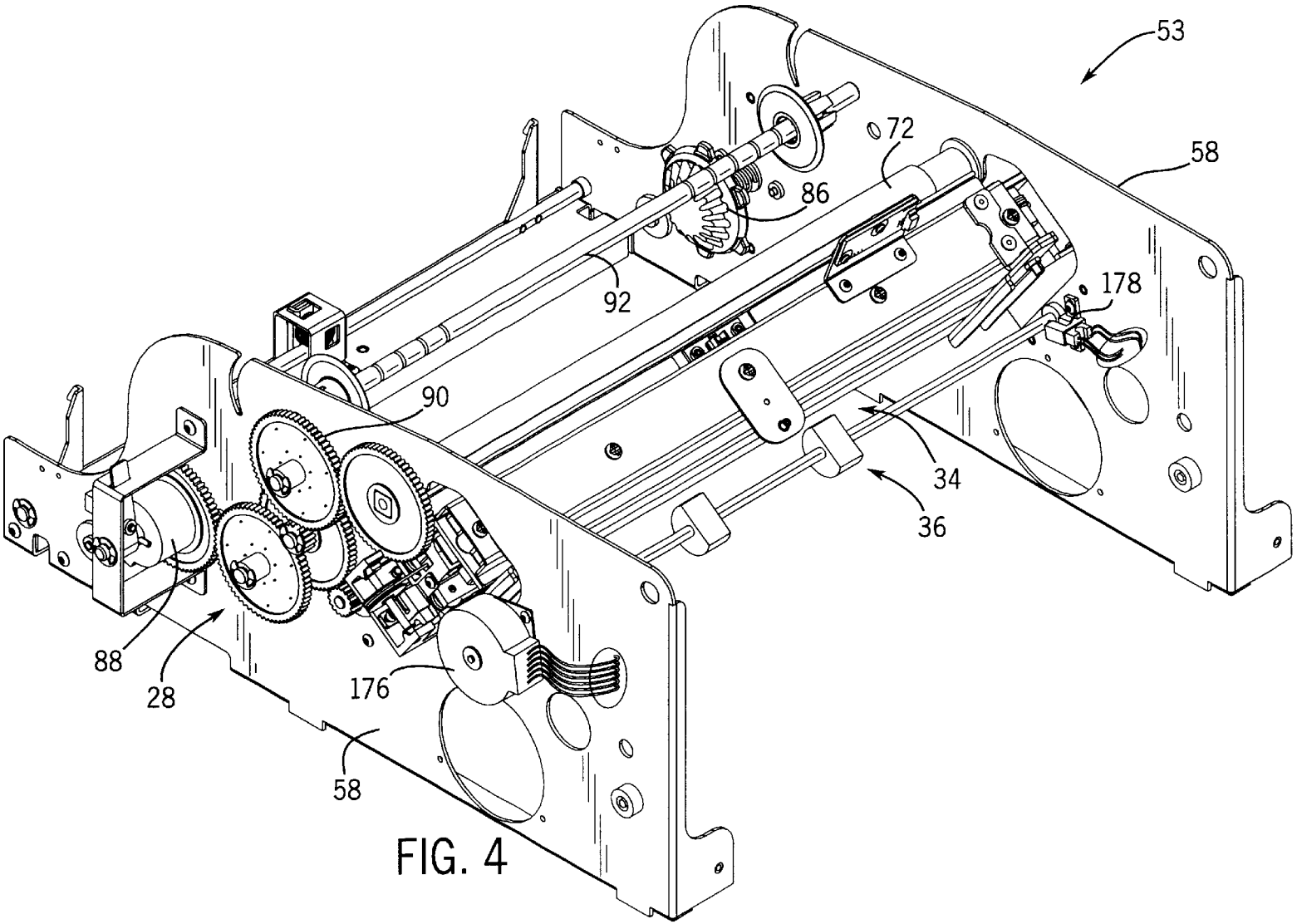
FIG. 4 is a rear, left side perspective view of the printer chassis lower frame of FIG. 3.
Figure 5:
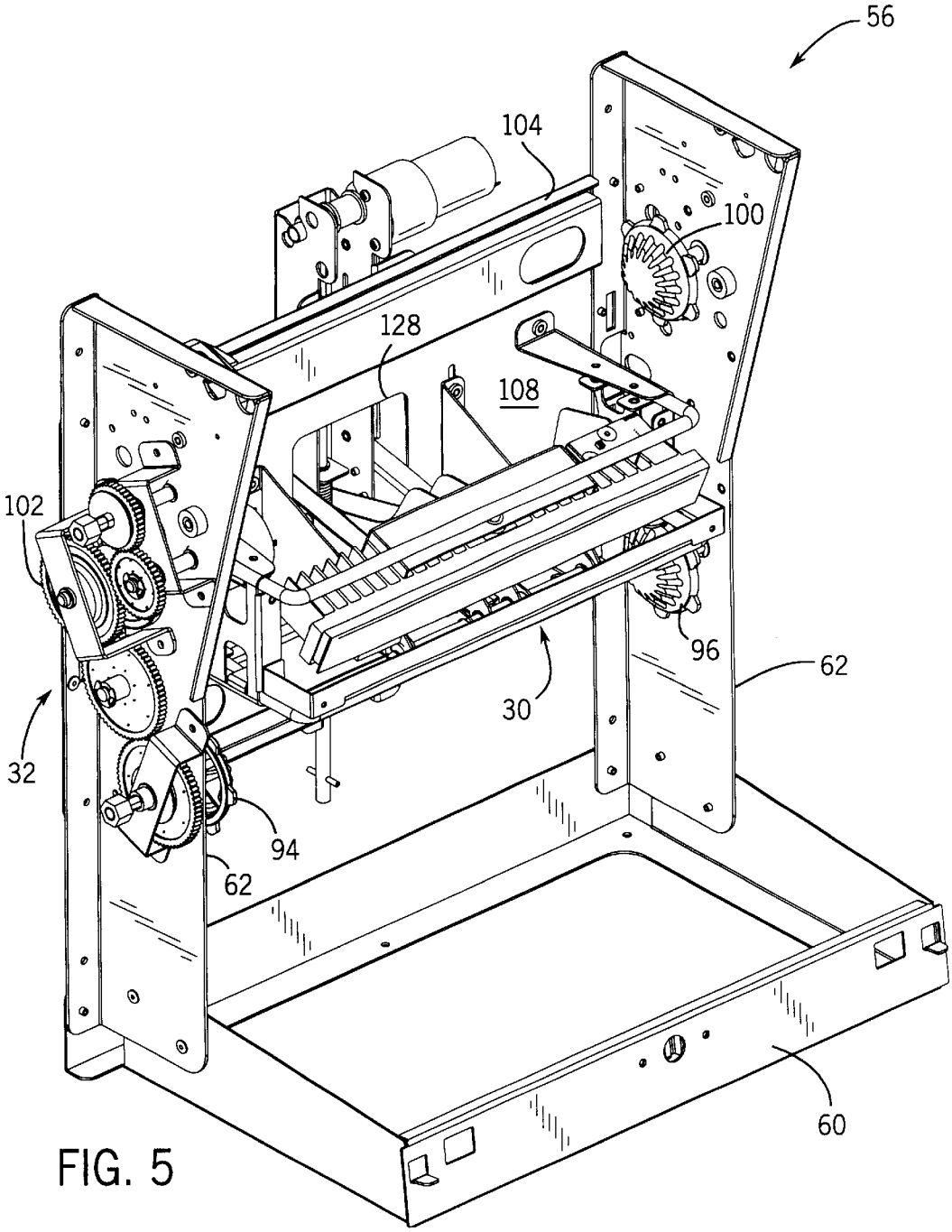
FIG. 5 is a bottom, left side perspective view of the printer chassis top frame of FIG. 3.
Figure 6:
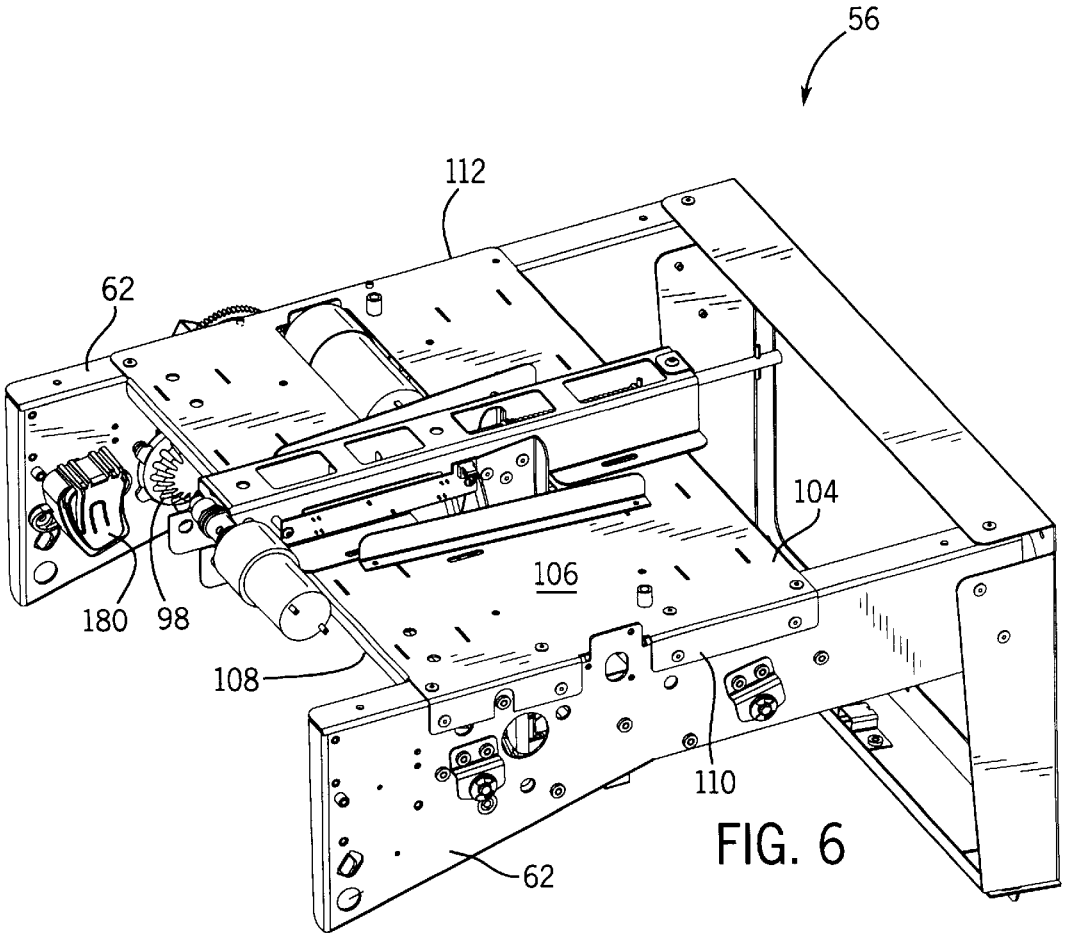
FIG. 6 is a top, right side perspective view of the printer chassis top frame of FIG. 3.

Referring to FIGS. 2–4, once the print head subassembly 30 completes printing labels 43 in a row on the labeling media 40, the labeling media drive subassembly 28 advances the printed labeling media 40 past the cutter subassembly 34. The cutter subassembly 34 cuts the printed labeling media 40 which is ejected by the label eject subassembly 36 down the exit chute 24, and out of the housing opening 26 (chute 24 and exit housing 26 are shown in FIG. 2). The cutter subassembly 34 and label eject subassembly 36 are fully described in a co-pending U.S. patent application entitled "PRINTER WITH CUTTER EJECT SYSTEM," having U.S. Ser. No. 09/349,530, filed concurrently with the present application, and which is fully incorporated herein by reference.

Referring to FIGS. 1–13, in use, a user loads the labeling media supply spool 70 into the printer 10, and slips the chip holder 179 into the receptacle slot 224 to electrically connect the memory device 175 to the printer circuitry 44. The circuitry 44 in the printing machine 10 reads the label inventory (and any other information) from the memory device 175, and drives the subassemblies 28, 30, 32, 34, and 36 to advance the labeling media 40 into position for printing on the first available label. The printer 10 then prints desired indicia on the labels 43, beginning with the first available label. Each time the printer 10 prints on a label, the printer circuitry 44 updates the memory device 175 to reflect the unavailability of the printed label. Advantageously, if the supply spool 70 is removed from the printer 10 prior to consuming all of the labels 43, or the printer 10 is deenergized, the inventory of available labels on the spool 70 remains intact on the memory device 175. When the spool 70 is reloaded into a like configured printer, or the printer 10 is reenergized, the inventory of available labels is electrically communicated to the printer circuitry 44 to avoid wasting unused labels.

While there has been shown and described what are at present considered the preferred embodiment of the invention, it will be obvious to those skilled in the art that various changes and modifications can be made therein without departing from the scope of the invention defined by the appended claims.

We claim:

1. A printing system comprising:

a spool;

a plurality of labels disposed on said spool for use by the printing system during the operation of the printing system;

a memory device associated with said spool for storing data indicative of the inventory unused labels on said spool;

data stored in said memory device specifying the inventory of said plurality of labels; and printer circuitry electrically connected to said memory device, said circuitry having means operable to read said data from said memory device to determine the unused labels on said spool that are available for printing and means operable to update said data stored in said memory device when one or more labels are used by the printing system.

2. The printing system as in claim 1, in which said memory device includes circuitry which is nonvolatile and electrically alterable.

3. The printing system as in claim 1, including a chip holder for slidably attaching said memory device to said spool such that the memory device remains stationary when the spool is rotated during use, wherein said memory device is fixed to said chip holder.

4. The printing system as in claim 3, in which said chip holder has a loop which extends around the spool to slidably attach said chip holder to said spool.

5. The printing system as in claim 4, in which a groove is formed around the spool proximal an end of said spool for receiving said loop.

6. The printing system as in claim 1, in which other information is stored in said memory device, and the printer circuitry is operable to read the other information for controlling the printing operation.

7. A printing system comprising:

a chassis;

a spool supported by said chassis;

a plurality of labels disposed on said spool for use by the printing system during the operation of the printing system;

a memory device associated with said spool for storing data indicative of the inventory of unused labels on said spool;

data stored in said memory device specifying the inventory of said plurality of labels; and printer circuitry electrically connected to said memory device, said circuitry having means operable to read said data stored on said memory device to determine the unused labels on said spool that are available for printing and means operable to write to said memory device to update said data when one or more labels are used by said printing system.

8. The printing system as in claim 7, in which a pair of cones is rotatably mounted to said chassis, and said spool is supported between said cones.

9. The printing system as in claim 7, in which said memory device includes circuitry which is nonvolatile and electrically alterable.

10. The printing system as in claim 7, including a chip holder for slidably attaching said memory device to said spool such that the memory device remains stationary when the spool is rotated during use, wherein said memory device is fixed to said chip holder.

11. The printing system as in claim 10, in which said chip holder has a loop which extends around the spool to slidably attach said chip holder to said spool.

12. The printing system as in claim 11, in which a groove is formed around the spool proximal an end of said spool for receiving said loop.

13. The printing system as in claim 7, in which other information is stored in said memory device, and the printer circuitry is operable to read the other information for controlling the printing operation.

* * * * *